US006851672B1

(12) United States Patent
Shmaiser et al.

(10) Patent No.: US 6,851,672 B1
(45) Date of Patent: Feb. 8, 2005

(54) SHEET TRANSPORT POSITION AND JAM MONITOR

(75) Inventors: Aron Shmaiser, Rishon-Lezion (IL); Yaron Zarfaty, Nes-Ziona (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 10/257,823

(22) PCT Filed: Apr. 18, 2000

(86) PCT No.: PCT/IL00/00231

§ 371 (c)(1),
(2), (4) Date: Oct. 17, 2002

(87) PCT Pub. No.: WO01/79096

PCT Pub. Date: Oct. 25, 2001

(51) Int. Cl.[7] ..... B65H 5/08

(52) U.S. Cl. ..... 271/276; 271/275; 271/260; 271/265.02

(58) Field of Search ..... 271/275, 259, 271/260, 258.04, 258.01, 265.01, 265.02, 276; 355/75, 76, 53, 407, 408; 399/21, 16

(56) References Cited

U.S. PATENT DOCUMENTS

| | | | | |
|---|---|---|---|---|
| 3,734,015 A | | 5/1973 | Camis et al. | |
| 3,741,643 A | | 6/1973 | Smith et al. | |
| 3,777,158 A | | 12/1973 | Kamogawa et al. | |
| 4,165,689 A | | 8/1979 | Giuiuzza | |
| 4,176,941 A | * | 12/1979 | Breitenkam et al. | 399/24 |
| 4,186,662 A | | 2/1980 | Borneman | |
| 4,198,642 A | | 4/1980 | Gamblin | |
| 4,202,268 A | | 5/1980 | Becker | |
| 4,204,471 A | | 5/1980 | Becker | |
| 4,204,472 A | | 5/1980 | Borneman | |
| 4,240,346 A | | 12/1980 | Landis et al. | |

(List continued on next page.)

FOREIGN PATENT DOCUMENTS

| | | |
|---|---|---|
| DE | 41 14 320 | 11/1992 |

(List continued on next page.)

OTHER PUBLICATIONS

Cannon, Inc.; JP–53–010441 A; Jan. 30, 1978 & Patent Abstracts of Japan; vol. 002; No. 045 (E–024); Mar. 27, 1978.

Fuji Photofilm Vo. Ltd.; JP 63–094287 A; Apr. 25, 1988 & Patent Abstracs of Japan; vol. 012; No. 331 (P–755); Sep. 7, 1988.

Hitachi Koki Co. Ltd.; JP 03–179470 A; Aug. 5, 1991 & Patent Abstracts of Japan; vol. 015; No. 433 (P–1271); Nov. 5, 1991.

Izawa, A.; JP 61–248838; Nov. 6, 1986 & Patent Abstracts of Japan; vol. 011, No. 098; Mar. 27, 1987.

*Primary Examiner*—Donald P. Walsh
*Assistant Examiner*—Kaitlin Joerger
(74) *Attorney, Agent, or Firm*—Fenster & Company

(57) ABSTRACT

A sheet transport system (20) comprising at least one sheet transporter (30,36) that receives and hands off a sheet being transported by the system so as to transport the sheet from a first position to a second position, wherein the at least one transporter (30,36) comprises at least one orifice (44) through which air is aspirated to create a vacuum that grips a sheet when it is received by the transporter (30,36); a vacuum system coupled to the at least one orifice (44) controllable to aspirate air through the at least one orifice (44) to grip the sheet; at least one vacuum sensor (60) that generates signals responsive to magnitude of vacuum of the at least one orifice (44); and a controller (49) that receives the signals generated by the at least one vacuum sensor (60) and provides a signal indicative of a location of the sheet in the transport system (20) from the signals.

24 Claims, 3 Drawing Sheets

U.S. PATENT DOCUMENTS 4,369,964 A * 1/1983 Jinnai et al. ..... 271/260
4,375,326 A 3/1983 Lang
4,378,734 A 4/1983 Wirz
4,410,897 A 10/1983 Moriguchi et al.
4,428,667 A 1/1984 Phelps et al.
4,431,303 A 2/1984 Hoffman
4,568,169 A 2/1986 Wada et al.
4,607,940 A 8/1986 Quang
4,621,576 A 11/1986 Wirz
4,639,126 A 1/1987 Bushaw et al.
4,684,238 A 8/1987 Till et al.
4,721,041 A 1/1988 Simeth
4,723,489 A 2/1988 Emrich et al.
4,745,282 A 5/1988 Tagawa et al.
4,791,869 A 12/1988 Furukawa
4,806,079 A 2/1989 Kuhn
4,814,822 A 3/1989 Acquaviva et al.
4,821,643 A 4/1989 Wieland
4,884,794 A 12/1989 Dinatale et al.
4,949,949 A 8/1990 Holmes et al.
4,967,660 A 11/1990 Yamanari et al.
4,974,027 A 11/1990 Landa et al.
5,003,355 A 3/1991 Tanzawa
5,010,551 A * 4/1991 Goldsmith et al. ..... 714/46
5,020,788 A 6/1991 Hatano et al.
5,034,780 A * 7/1991 Kotabe et al. ..... 399/21
5,110,159 A 5/1992 Herold et al.
5,170,211 A 12/1992 Haupt et al.
5,385,091 A 1/1995 Cuir et al.
5,439,029 A 8/1995 Becker
5,552,875 A 9/1996 Sagiv et al.
5,606,913 A 3/1997 Kowalewski
5,615,609 A 4/1997 Hill et al.
5,710,964 A 1/1998 Tombs et al.
5,752,776 A 5/1998 Kunreuther
5,772,343 A 6/1998 Beretta et al.
5,802,424 A 9/1998 Pernesky et al.
5,837,408 A 11/1998 Parker et al.
5,961,228 A 10/1999 Ward et al.
5,963,770 A 10/1999 Eakin
5,970,274 A 10/1999 Rath
5,996,994 A 12/1999 Becker
6,059,705 A 5/2000 Ruthenberg et al.
6,072,996 A 6/2000 Smith
6,088,565 A 7/2000 Jia et al.
6,122,468 A 9/2000 Sakamoto et al.
6,144,836 A 11/2000 Umeda et al.
6,185,399 B1 2/2001 Zhao et al.
6,219,516 B1 4/2001 Furst et al.
6,271,937 B1 8/2001 Zuber
6,382,092 B1 5/2002 Van Den Brink et al.
6,412,409 B2 7/2002 Weishew
6,418,847 B1 7/2002 Holecek
6,705,610 B2 * 3/2004 Schumann ..... 271/276

FOREIGN PATENT DOCUMENTS

DE 196 35 388 3/1998
DE 198 10 239 7/1999
EP 0 161 522 11/1985
EP 0 274 989 7/1988
EP 0 311 924 4/1989
EP 0 312 660 4/1989
EP 0 342 704 11/1989
EP 0 435 164 7/1991
EP 0 562 269 9/1993
EP 0 570 786 11/1993
EP 0 583 928 2/1994
EP 0 615 941 9/1994
EP 0 616 886 9/1994
EP 0 813 971 12/1997
EP 0 861 722 9/1998
EP 0 878 311 11/1998
FR 2 358 273 2/1978
WO WO 90/04216 4/1990
WO WO 93/01531 1/1993
WO WO 93/04409 3/1993
WO WO 94/23347 10/1994
WO WO 95/10801 4/1995
WO WO 96/17277 6/1996
WO WO 97/07433 2/1997
WO WO 99/61958 12/1999
WO WO 01/02910 1/2001
WO WO 01/34397 5/2001
WO WO 01/53895 7/2001

* cited by examiner

SHEET TRANSPORT POSITION AND JAM MONITOR

RELATED APPLICATIONS

The present application is a U.S. national application of PCT/IL00/00231, filed 18 Apr. 2000.

FIELD OF THE INVENTION

The invention relates to sheet transport systems and in particular to monitoring the position of a sheet in a sheet transport system and determining the location of a sheet that jams in the system.

BACKGROUND OF TE INVENTION

A printing machine generally comprises a sheet transport system that receives sheets from a sheet feeder, moves the sheets through various printing stations in the printer and after the sheets are printed transports the sheets to an output tray. Sensors that "watch" for the passage of a sheet as the sheet transport system moves the sheet through the printer monitor the position of the sheet. Usually the sensors are optical sensors or contact sensors that sense a leading and/or trailing edge of the sheet as the edge passes through their respective fields of view or contract positions. The sensors do not provide continuous real time information as to where the sheet is at all times as it passes through the sheet transport system. As a result, if the sheet jams it is often difficult to locate the position at which it jammed and a position of a cause of the jam. In addition, optical and contact sensors are readily dirtied by dust, such as paper dust, from sheets transported by a transport system and have to be cleaned regularly.

U.S. Pat. No. 4,369,964 describes a sheet feed apparatus that senses if a sheet fed to an impression roller of a printer seats properly on the roller. The roller is formed with two longitudinal slots that communicate with a source of vacuum that aspirates through the slots. When a sheet to be printed is transferred to the roller, the sheet covers the slots and vacuum generated by the vacuum source at the slots as a result of aspiration of the vacuum source secures the sheet in position on the roller surface. If the sheet doesn't seat properly on the roller surface the sheet doesn't completely cover both slots. As a result, the vacuum developed by the vacuum pump at the slots drops below or doesn't attain full magnitude. A pressure sensor senses that the vacuum is below what it should be and generates an alum indicating a malfunction.

The system comprises the impression roller and a set of vacuum suckers that deliver sheets to the roller. The system does not indicate a jam or malfunction of the sucker "delivery system". The system does not determine if a sheet is improperly seated on the roller as a result of the sheet jamming at a position of the suckers or the suckers improperly holding the sheet and/or transferring the sheet to the roller improperly.

SUMMARY OF THE INVENTION

An aspect of some embodiments of the present invention relates to providing a sheet transport system comprising a sheet position monitoring system that senses the position of a sheet passing through the system at all times during which the sheet is being transported by the transport system.

An aspect of some embodiments of the present invention relates to providing a sheet transport system that senses when a sheet jams or is improperly transported by the transport system and determines where the jam or faulty transport occurs.

An aspect of some embodiments of the present invention relates to providing a sheet transport system that provides a real time display of location of a sheet being transported by the system as the sheet moves through the system.

A sheet transport system in accordance with an exemplary embodiment of the present invention comprises a plurality of sheet transporters that transport sheets from a first position to a second position. The transporters receive and hand off one to the other sheets being transported from the first position to the second position. Bach transporter is coupled to a source of vacuum controllable to aspirate air through at least one orifice formed in a structure of the transporter. The transporter grips and holds a sheet when the sheet covers the at least one orifice and the vacuum source is controlled to aspirate through the orifice so as to create a vacuum at the orifice.

In some embodiments of the invention, when a first transporter hands off a sheet it is holding to a second transporter, the sheet is positioned so that it covers the at least one orifice of the second transporter. Vacuum holding the sheet to the at least one orifice of the first transporter is deceased so that the first transporter releases the sheet. Vacuum at the at least one orifice of the second transporter is increased so that the second transporter grips the sheet and removes it from the first transporter.

The magnitude of the vacuum near to or at the at least one orifice of each transporter is monitored by a suitable sensor, hereinafter referred to as a "vacuum sensor". The vacuum sensor may be a sensor such as a pressure sensor that measures vacuum directly or a sensor, such as a flow meter or other sensor that indicates presence of a vacuum, that provides measurements from which the vacuum can be inferred.

In some embodiments of the invention, at any one time during the passage of a sheet through the sheet transport system, which of the transporters in the system is holding the sheet can be determined from vacuum sensed by the vacuum sensors. When a transporter is holding the sheet and the sheet is properly seated on the transporter, its at least one orifice is covered by the sheet and a maximum vacuum suitable for holding the sheet is generated by the vacuum source at the orifice. This maximum vacuum is hereinafter referred to as a "gripping vacuum". On the other hand if a transporter is not holding the sheet, vacuum at the transporter's at least one orifice is substantially equal to zero. (The vacuum system is usually controlled not to aspirate air through the at least one orifice of a transporter not intended to hold the sheet and vacuum at the at least one orifice is of course substantially equal to zero. It should be noted however that even if air is aspirated through the transporters at least one orifice, vacuum at the orifice will still be substantially equal to zero or very low because the orifice is not covered.) The position of the sheet can be determined from the position and orientation of the transporter holding the sheet. In some embodiments of the present invention positions of transporters in the sheet transport system are determined using methods and devices known in the art, such a suitable encoder.

In addition, vacuum readings may, for some embodiments of the invention, indicate if the sheet being held by a transporter is properly seated on the transporter's at least one orifice. If the sheet does not cover all of the at least one orifice properly, as might happen for example if the sheet jams in the transport system or falls off the transporter, vacuum at the at least one orifice is reduced below the gripping vacuum. The occurrence of the jam is indicated by a low, aberrant vacuum reading by a vacuum sensor associated with the transporter, which is, or should, be holding the sheet. The location of the jam is indicated by which pressure sensor is sensing the aberrant vacuum and the position of the transporter holding the jammed sheet.

In some embodiments of the present invention, the sheet transport system comprises a video monitor and vacuum readings by the vacuum sensors are used to provide a real time display of progress of the sheet on the monitor as the sheet moves through the transport system. If the transport system malfunctions and the sheet is improperly transported, a location in the transport system at which the sheet is improperly transported may be indicated on the video monitor.

Some sheet transport systems, in accordance with an embodiment of the present invention, may comprise only a single transporter for moving a sheet from a first position to a second position. The transporter comprises at least one orifice formed in a structure of the transporter coupled to a source of vacuum for holding a sheet that the transporter transports. At least one vacuum sensor senses vacuum at the at least one orifice to monitor transport of sheets by the transporter.

In some embodiments of the present invention, sheet transporters are rotating sheet transporters. Each transporter comprises a rotatable shaft and in some embodiments at least one array of suction cups, i.e. "orifices", for gripping a sheet. The suction cups are mounted to the shaft and communicate with a source of vacuum. Sheet transport systems for printers comprising rotating sheet transporters having suction cups for holding a sheet are described in PCT Applications PCT/IL98/00553, PCT/IL99/00600 and PCT/IL00/00081 which are incorporated herein by reference.

There is therefore provided in accordance with an embodiment of the present invention, a sheet transport system comprising: at least one sheet transporter that receives and hands off a sheet being transported by the system so as to transport the sheet from a first position to a second position, wherein the at least one transporter comprises at least one orifice through which air is aspirated to create a vacuum that grips a sheet when it is received by the transporter, a vacuum system coupled to the at least one orifice controllable to aspirate air through the at least one orifice to grip the sheet; at least one vacuum sensor that generates signals responsive to magnitude of vacuum at the at least one orifice; and a controller that receives the signals generated by the at least one vacuum sensor and provides a signal indicative of a location of the sheet in the transport system from the signals. In some embodiments the vacuum system is controllable to release air to the at least one orifice to release the sheet.

Additionally or alternatively, the controller uses signals from the at least one vacuum sensor to determine if a sheet being transported by a transporter of the at least one transporter is being transported properly.

In some embodiments of the present invention, the sheet transport system includes a video monitor on which the controller displays the location of sheets being transported by the transport system. If a malfunction occurs in the transport system and at a particular location in the transport system a sheet is improperly transported, the controller may indicate the particular location on the video monitor.

In some embodiments of the present invention, the transport system comprises a transporter position monitor that continuously monitors position of a transporter of the at least one transporter and generates signals responsive thereto. The controller may use signals from the transporter position monitor to determine a location of a sheet being transported by the sheet transport system.

In some embodiments of the present invention the controller determines that a transporter of the at least one transporter is gripping a sheet being transported by the transport system and that the sheet is gripped properly if signals from a vacuum sensor of the at least one vacuum sensor indicate that vacuum sensed by the sensor is greater than a first pre-determined level of vacuum.

In some embodiments of the present invention the controller determines that a transporter of the at least one transporter is not gripping a sheet being transported by the transport system if signals from the at least one vacuum sensor indicate that vacuum sensed by the at least one vacuum sensor is less than a second pre-determined level of vacuum.

In some embodiments of the present invention the controller determines that a transporter of the at least one transporter is gripping a sheet being transported by the transport system, but that the sheet is gripped improperly, if signals from a vacuum sensor of the at least one vacuum sensor indicate that the vacuum sensed by the sensor is between the first and second vacuum levels.

In some embodiments of the present invention the at least one transporter comprises a plurality of sheet transporters. In some embodiments of the present invention, sheet transporters of the plurality of sheet transporters seriatim receive and hand off a sheet being transported by the system so as to transport the sheet from the first position to the second position.

In some embodiments of the present invention, a transporter of the at least one transporter is a rotary transporter, which rotates about an axis to receive and hand off a sheet being transported by the transport system.

In some embodiments of the present invention, an orifice of the at least one orifice is a suction cup.

In some embodiments of the present invention, the vacuum sensor is a pressure sensor.

In some embodiments of the present invention, the vacuum sensor is a flow meter.

In some embodiments of the present invention, the sheet transport system is a transport system that transports sheets printed in a printing system comprising at least tone printing station and wherein the first and second positions are positions of the sheets in the printing system. At least one of the first and second positions may be a position in a printing station of the at least one printing station. The printing station may comprise an impression roller. In some embodiments of the present invention, at the position in the printing station, a sheet is removed from the impression roller. In some embodiments of the present invention, at the position in the printing station a sheet is mounted on the impression roller.

There is further provided in accordance with an embodiment of the present invention, a sheet transport system comprising: at least one sheet transporter that receives and hands off a sheet being transported by the system so as to transport the sheet from a first position to a second position; a plurality of sensors that generates signals responsive to a position of a sheet as it is transported by the transport system; a display screen; and a controller that receives the signals generated by the sensors and uses the signals to provide a real time visual display on the screen of a sheet as it moves through the transport system. In some embodiments of the present invention, the visual display shows the sheet in continuous motion moving through the transport system.

BRIEF DESCRIPTION OF FIGURES

Non-limiting embodiments of the present invention are described below with reference to figures attached hereto. In the figures, identical structures, elements or parts that appear in more than one figure are generally labeled with the same numeral in all the figures in which they appear. Dimensions of components and features shown in the figures are chosen for convenience and clarity of presentation and are not necessarily shown to scale. The figures are listed below.

DETAILED DESCRIPTION OF EMBODIMENTS

Figure 1:
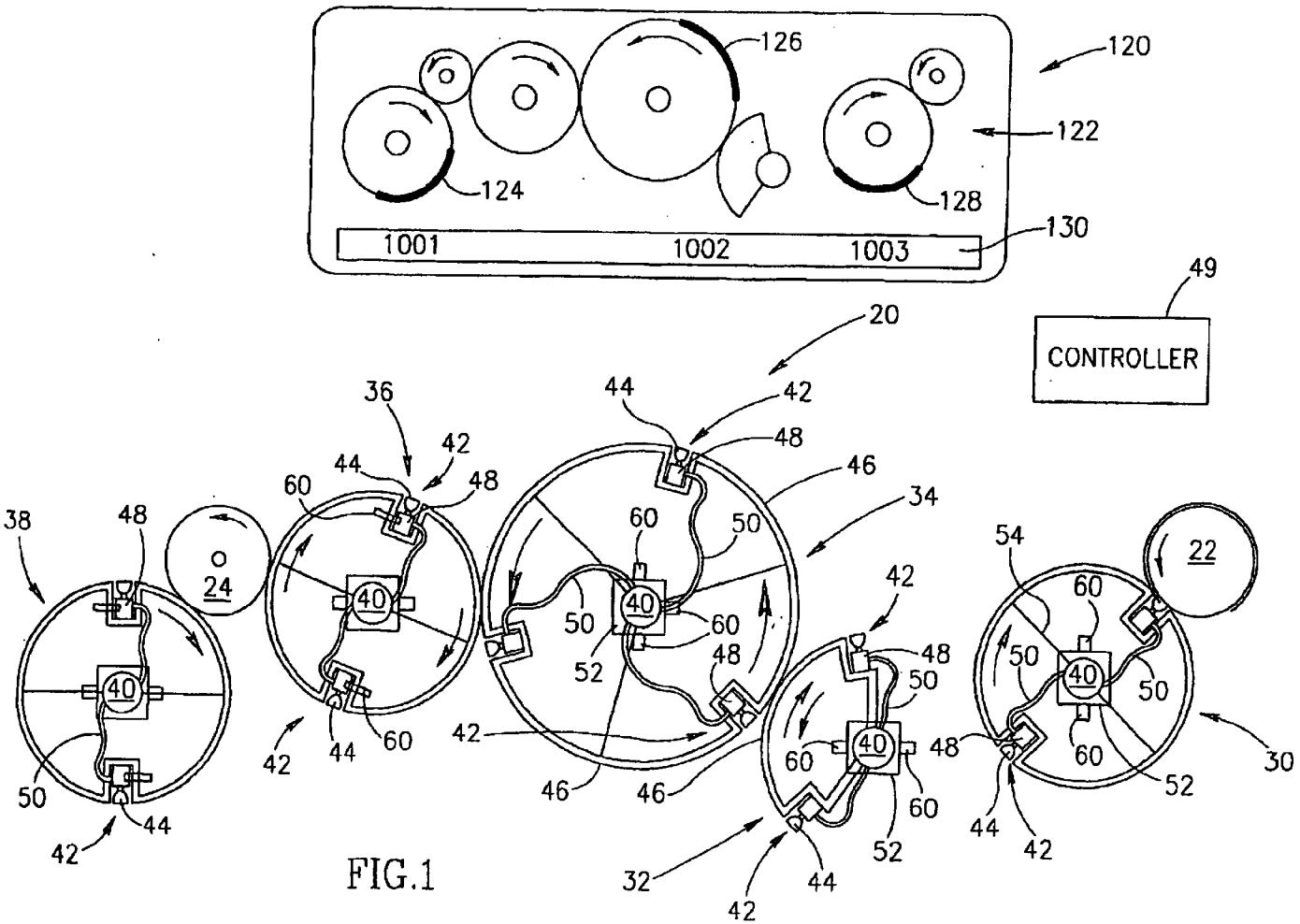
FIG. 1 schematically shows a sheet transport system comprising rotary transporters and a sheet position monitoring system for sporting sheets in a tandem printer, in accordance with an embodiment of the present invention.

FIG. 1 schematically shows a side view of an example of a sheet transport system 20, in accordance with an embodiment of the present invention, for transporting sheets from a first impression roller 22 of a tandem printer to a second impression roller 24 of the tandem printer.

Transport system 20 may comprise four rotary transporters 30, 32, 34, 36 that remove a sheet from impression roller 22 after a first side of the sheet is printed and seriatim hand the sheet off one to the other to transfer the sheet to impression roller 24 where a second side of the sheet is printed. In some embodiments a transporter 38 removes the sheet from impression roller 24 after the second side is printed and transports the sheet to an output tray or another impression roller (not shown).

By way of example, rotary transporters 30, 34, 36 and 38 are similar in construction and when transport system 20 is transporting a sheet from impression roller 22 to impression roller 24 each rotates with a substantially constant rotation. In the embodiment shown, transporter 32, which moves a sheet from transporter 30 to transporter 34 is a perfector transporter. Perfector transporter 32 operates to turn a sheet over as it transfers the sheet from transporter 30 to transporter 34 and during transfer of the sheet, perfector transporter 32 changes direction rotation from counterclockwise to clockwise. Direction of rotation of each transporter 30–38 is indicated by curved arrows inside the transporter. Features and mode of operation of sheet transport systems similar to sheet transport system 20 are described in PCT applications PCT/IL98/00553, PCT/IL99/00600 and PCT/IL00/00081 referenced above. Whereas the embodiment of transport system 20 in FIG. 1 uses a perfector to reverse the sheet, other means known in the art for inverting a sheet where such reversal is desired, may be used in place of the perfector system.

Figure 2:
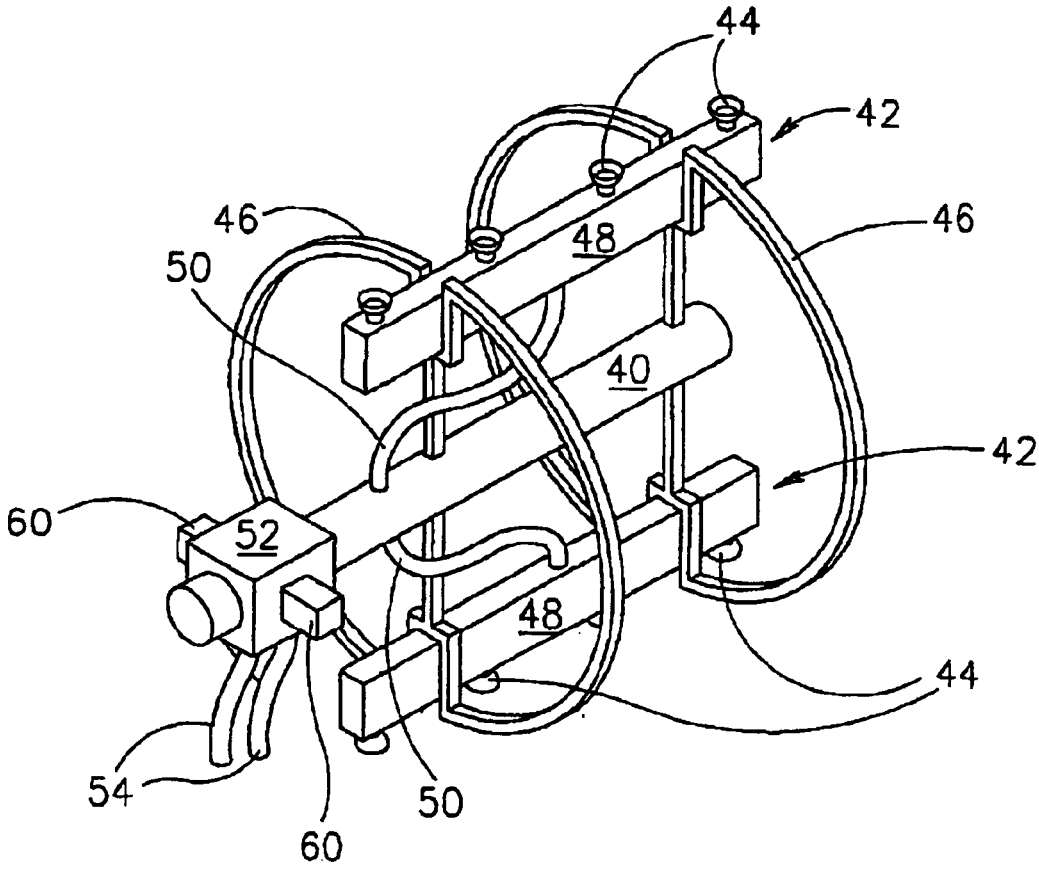
FIG. 2 schematically shows a perspective view of a rotary transporter comprised in the transport system shown in FIG. 1.

Each transporter 3038 comprises a shaft 40, about which it rotates, and by way of example at least one linear array 42 of suction cups 44 for gripping a sheet being transported by the transporter. In some embodiments transporters 30–38 comprise two or more support rims 46 on which a sheet gripped by the transporter lies. Suction cups 44 in a suction cup array 42 of a transporter 30–38 may be mounted on a manifold 48 mounted to the transporter's support rims 46. To avoid clutter only some elements common to all transporters 30–38 are labeled with their identifying numeral. In the side view of transport system 20 shown in FIG. 1 only one suction cup 44 of a linear suction cup array 42 and only one support rim 46 of a transporter 30–38 is shown FIG. 2 shows features of the embodiment of transporter 30 in perspective view.

In an embodiment of the present invention manifold 48 of each suction cup array 42 comprised in a transporter 30–38 is connected via a pressure hose 50 to a different "vacuum" channel (not shown) in the shaft 40 of the transporter. The vacuum channels are coupled to an appropriate vacuum system (not shown) using devices known in the art such as rotary joints or in some embodiments, a vacuum distributor of a type described in PCT Application PCT/IL00/00081. In FIGS. 1 and 2 vacuum channels are schematically shown coupled to a vacuum system via vacuum distributors 52. FIG. 2 shows transporter 30 with a vacuum distributor 52 and a pressure hose 50 for each of two vacuum channels (not shown) in its shaft 40 that couples the vacuum channel and thereby one of manifolds 48 to the vacuum system. A controller 49 (FIG. 1) controls the vacuum system to aspirate air through or release air to suction cups 44 of each suction cup array 42 so that the suction cups respectively grip and release a sheet being transported by transport system 20 at appropriate times.

In some embodiments, for each suction cup array 42, a vacuum sensor 60 measures (directly or indirectly) vacuum at suction cups 44 of the array. Vacuum sensor 60 may be coupled to the vacuum distributor 52 that communicates vacuum to the array. Vacuum sensors 60 can be any suitable sensors useable for determining level of vacuum at suction cups 44. Vacuum sensors 60 can, for example, be pressure sensors that measure vacuum directly or flow meters that provide measurements of air flow through suction cups 44, from which presence of vacuum can be determined.

Each vacuum sensor 60 generates signals responsive to vacuum it senses and transmits the signals to controller 49. When a suction cup array 42 is gripping a sheet, pressure at suction cups 44 of the array is at a minimum and signals from vacuum sensor 60 monitoring vacuum at the suction cup array indicate a maximum gripping vacuum at the suction cups. When a suction cup array 42 is not gripping a sheet, pressure at the suction cup array is high and may be substantially equal to atmospheric pressure and signals from its vacuum sensor 60 indicate this situation. If a sheet being held by a suction cup array 42 is not properly seated on the array's suction cups, for example as a result of the sheet jamming, vacuum sensor 60 of the suction cup array will indicate an aberrant vacuum intermediate zero vacuum and the gripping vacuum.

In some embodiments, controller 49 uses vacuum readings from vacuum sensors 60 to continuously monitor the location and orientation of a sheet being transported by sheet transport system 20 as the sheet progresses through the system. Vacuum readings from vacuum sensors 60 indicate which suction cup array, and therefore which transporter 3038, is holding the sheet at a given time. Angular position of the sheet is determined from the rotational orientation of the transporter holding the sheet. In some embodiments, rotational orientation of each transporter 3038 at any given time may be known from a structure of a transmission system used to rotate the transporters and a suitable encoder coupled to the transmission system, collectively referred to as a transporter position monitor. The encoder may be coupled to an appropriate moving structure of the transmission system or to a transporter, such as for example a shaft 40 of one of the transporters, using methods and devices known in the art. An aberrant vacuum reading by a vacuum sensor 60 indicates a transport system malfunction and/or that the sheet is not properly seated on a suction cup array. Location of the malfunction and/or jam may be determined from a position of the suction cup array 42 whose vacuum sensor 60 indicates the aberrant vacuum.

In some embodiments of the present invention, transport system 20 comprises a video monitor 120. Controller 49 may use signals from vacuum sensors 60 and from the system encoder to display in real time on video monitor 120 positions of sheets being transported by transport system 20. In some embodiments, controller 49 controls video monitor 120 to show an image 122 of transport system 20 and displays positions of sheets being transported by transport system 20 by displaying images of the sheets on the transport system image 122. In some embodiments, a number or other designation identifies each sheet transported by transport system 20 and the same number identifies an image of the sheet displayed on transport system image 122. Video display 120 in FIG. 1 shows three sheets 124, 126 and 128 being transported by transport system 20. Transport system identification numbers, "1001", "1002" and "1003" for sheets 124, 126 and 128 are shown in a rectangular fame 130 at the bottom of video monitor 120. Bach of the transport system identification numbers is located in frame 130 under the image of its corresponding sheet. In some embodiments of the present invention controller 49 displays, or can be programmed to display, on monitor 120, vacuum readings from suction cup arrays 42, as a function of time.

Figure 3:
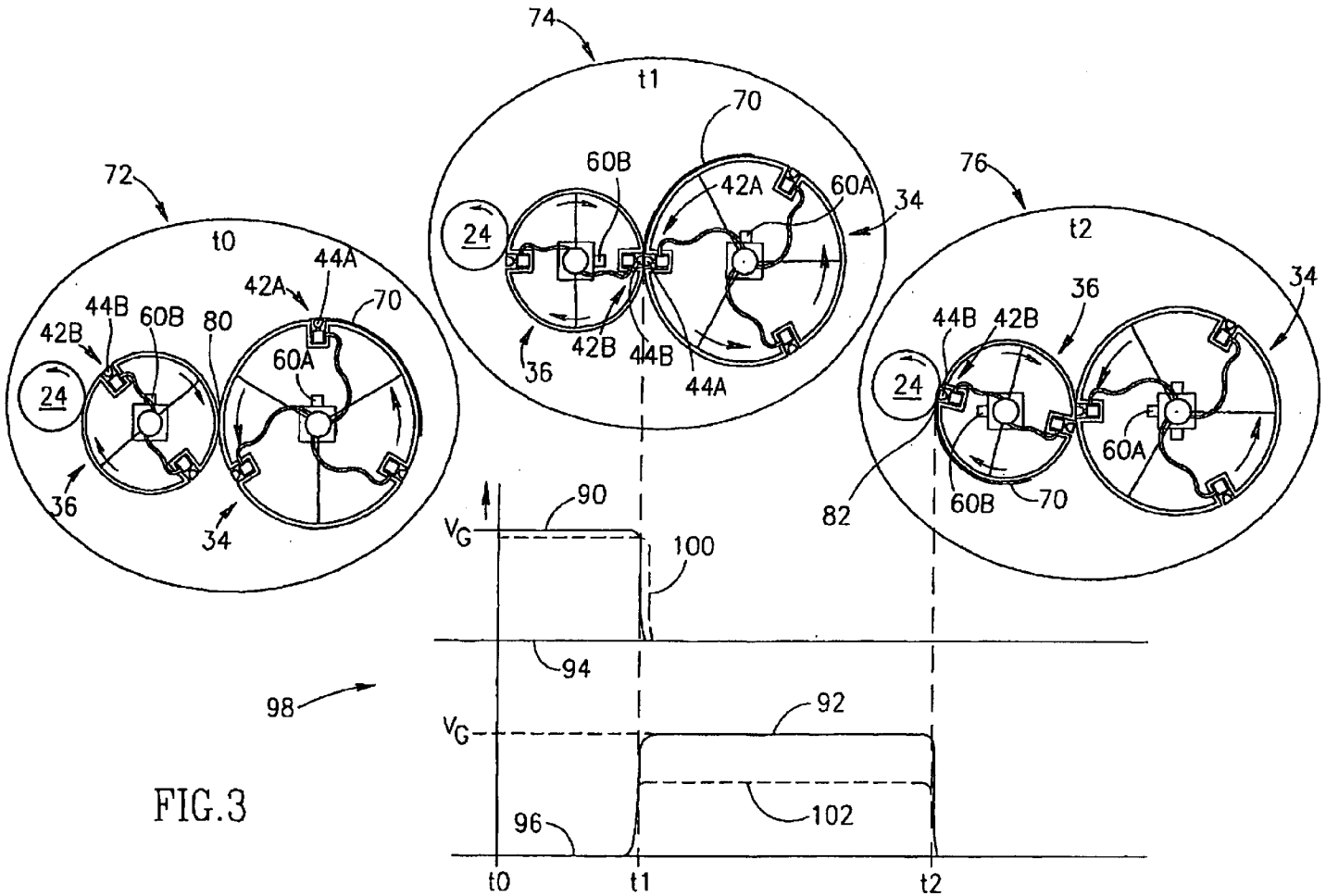
FIG. 3 schematically shows transport of a sheet by transporters of the transport system shown in FIG. 1 and vacuum readings from pressure sensors of the transporters that monitor the transport, in accordance with an embodiment of the present invention.

FIG. 3 schematically shows transport of a sheet 70 by transporters 34 and 36 of the embodiment of transport system 20 shown in FIG. 1 to impression roller 24 and vacuum readings from vacuum sensors of the transporters that monitor the transport. Suction cup array 42 of transporter 34 (FIG. 1) that is involved in the transport of sheet 70 is labeled 42A in FIG. 3 and its suction cups are labeled 44A. Vacuum sensor 60 that monitors vacuum at suction cups 44A is labeled 60A. Suction cup array 42 of transporter 34, which is involved in the transport of sheet 70, its suction cups 44 and its corresponding vacuum sensor 60 are similarly labeled 42B, 44B and 60B respectively. Features of transport system 20 not germane to the discussion of the hand off of sheet 70 are not shown in FIG. 3.

Insets 72, 74 and 76 in FIG. 3 show position of sheet 70 and rotational orientations of transporters 34 and 36 at times $t_0$, $t_1$ and $t_2$ respectively. In inset 72, at time to, sheet 70 is being held by transporter 34 which is rotating sheet 70 towards a handoff position 80 between transporter 34 and transporter 36. When sheet 70 reaches handoff position 80, transporter 34 hands off the sheet to transporter 36. In inset 74 at time $t_1$ sheet 70 has reached handoff position 80 and transporter 34 is handing off sheet 70 to transporter 36. In inset 76, at time $t_2$ after transporter 36 has received sheet 70 from transporter 34, transporter 36 has rotated sheet 70 to a handoff position 82 between transporter 36 and impression roller 24 and is handing off sheet 70 to impression roller 24.

Vacuum readings from vacuum sensors 60A and 60B for a faultless transport of sheet 70 to impression roller 24 are shown as a function of time by solid line curves 90 and 92 respectively on time lines 94 and 96 of a graph 98. Between times $t_0$ and $t_1$ suction cup array 42A is gripping sheet 70. Sheet 70 is seated properly on suction cups 44A and vacuum sensor 60A indicates that vacuum at suction cup array 42A is at a maximum gripping vacuum "$V_G$". Shortly before time $t_1$, the vacuum system is controlled to aspirate air through suction cups 44B of suction cup array 42B and vacuum as indicated by curve 92 at suction cups 44B begins to increase rapidly. At time $t_1$, when sheet 70 is at handoff position 80, the vacuum system is controlled to rapidly reduce vacuum at suction cups 44A to zero and transporter 34 releases sheet 70. At handoff position 80 suction cups 44A are opposite suction cups 44B and sheet 70 covers suction cups 44B as well as well as covering suction cups 44A. Vacuum readings from vacuum sensor 60B shown by solid curve 92 show vacuum at suction cups 44B rising rapidly to the gripping vacuum $V_G$, indicting that sheet 70 is properly seated on suction cups 44B. As transporters 34 and 36 rotate away from handoff position 80 transporter 36 removes sheet 70 from transporter 34. Vacuum at suction cups 44B remains stable at substantially $V_G$ until time $t_2$ at which time transporter 36 has rotated sheet 70 to handoff position 82 and the vacuum system is controlled to rapidly reduce vacuum at suction cups 44B to zero. Transporter 36 releases sheet 70 and impression roller 24 grips the sheet, by way of example with conventional sheet grippers (not shown) and removes sheet 70 from transporter 36.

Dashed curves 100 and 102 indicate vacuum readings from vacuum sensors 60A and 60B when a transport system malfunction causes a faulty handoff of sheet 70 from transporter 34 to transporter 36.

The malfunction is assumed to be, by way of example, a timing error in transport system 20 that causes a delay in reduction of vacuum at suction cups 44A. The reduction, which should occur at time $t_1$, is delayed and occurs slightly after time $t_1$ as indicated by curve 100. (Height of curve 100 is shown slightly lower than that of curve 90 for clarity.) Therefore, sheet 70 is not released on time by transporter 34 and both suction cup arrays 42A and 42B grip sheet 70 as transporters 34 and 36 rotate the suction cup arrays away from handoff position 82. As a result, when vacuum at suction cups 44A finally drops to zero, sheet 70 does not seat properly on suction cups 44B and after the handoff of sheet 70 to transporter 36 there is air leakage through some of suction cups 44B. Vacuum at suction cups 44B therefore does not increase to the gripping vacuum $V_G$. Vacuum readings from vacuum sensor 60B shown by dashed curve 102 are low and indicate the faulty handoff.

From graph 98 it is seen that vacuum readings from vacuum sensors 60A and 60B indicate at any given time during transport of sheet 70 from transporter 34 to impression roller 24 on which transporter 34 or 36 sheet 70 is located. In addition, the vacuum readings indicate if the transport of sheet 70 is performed properly. In a case where there is a malfunction in the transport of sheet 70 the pressure readings indicate the malfunction and are used, in accordance with an embodiment of the present invention, to analyze the malfunction and determine its cause. For example, in the faulty transport of sheet 70 described above vacuum readings from vacuum sensor 60B indicate that the cause of the faulty handoff between transporters 34 and 36 is the delayed reduction in vacuum at suction cup array 42A.

Whereas transporters 30, 34, 36 and 38 (FIG. 1) are shown, by way of example, gripping sheets that they transport using a single suction cup array, some transporters in accordance with an embodiment of the present invention, grip a sheet using more than one suction cup array. For such a transporter, information as to whether or not a sheet being transported by the transporter is gripped properly may be determined from vacuum readings from the more than one suction cup array gripping the sheet. For example in sheet transport system 20 perfector transporter 32 simultaneously grips a sheet that it transports and turns over with both its suction cup arrays 42. A first suction cup array 42 holds the sheet along a leading edge of the sheet and a second suction cup array 42 holds the sheet along a trailing edge of the sheet. Proper transport of the sheet by perfector transporter 32 from transporter 30 to transporter 34 depends upon proper synchronization of vacuum at the suction cup arrays so that the leading and trailing edges of the sheet are gripped and released at appropriate times. Vacuum readings from the suction cup array 42 gripping the leading edge of the sheet and vacuum readings from the suction cup array 42 griping the trailing edge of the sheet are used to monitor proper functioning of perfector transporter 32.

It should be noted that whereas a sheet position monitoring system is shown for sheet transport system 20, sheet position monitoring systems, in accordance with an embodiment of the present invention, are useable in sheet transport systems having configurations different from that of sheet transport system 20. For example, a sheet transport monitoring system similar to that shown for sheet transport system 20 can be used, in accordance with an embodiment of the present invention, with a "re-feed sheet transport system". A re-feed sheet transport system is described in PCT Applications PCT/IL98/00553 and PCT/IL00/00081 referenced above and shown in FIGS. 4–5F in the latter application.

Furthermore, whereas sheet transporters 3038 are shown as comprising "rim mounted" suction cup arrays for gripping sheets that they transport, other types of configurations for transporters, in accordance with embodiments of the present invention are possible and can be advantageous. For example, a rotary sheet transporter, in accordance with an embodiment of the present invention, can comprise a circularly cylindrical surface with at least one slot or circular shaped orifice therein, through which air is aspirated to grip a sheet. Or a sheet transporter can shuttle back and forth with a cyclic linear motion to transport a sheet from a first position to a second position. Such a "shuttle" transporter might comprise a planar surface with at least one orifice therein for griping a sheet. Other configurations for sheet transporters, in accordance with an embodiment of the present invention, will occur to persons of the art.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. The scope of the invention is limited only by the following claims.

What is claimed is:

1. A sheet transport system comprising:

at least one sheet transporter that receives and hands off a sheet being transported by the system so as to transport the sheet from a fire position to a second position;

a plurality of sensors that generates signals responsive to a position of a sheet as it is transported by the transport system;

a display screen; and a controller that receives the signals generated by the sensors and uses the signals to provide a real time visual display on the screen, of an image of a sheet, superimposed on an image of the transport system, as it moves through the transport system.

2. A sheet transport system according to claim 1 wherein the visual display shows the sheet in continuous motion moving through the transport system.

3. A sheet transport system according to claim 1 wherein visual display displays a plurality of such sheet images simultaneously as the sheets are transported by the transport system.

4. A sheet transport system according to claim 3 wherein each of said sheets is identified on said display by a designation of said sheet.

5. A sheet transport system according to claim 4 wherein the designation comprises identification numbers.

6. A sheet transport system according to claim 4 wherein if a malfunction occurs in the transport system and at a particular location in the transport system a sheet is improperly transported, the particular location is indicated on the display screen.

7. A sheet transport system according to claim 1 wherein the display screen is comprised in a video monitor.

8. A sheet transport system according to claim 1 wherein the sheet at least one transporter comprises:

at least one orifice through which air is aspirated to create a vacuum that grips a sheet when it is received by the transporter;

a vacuum system coupled to the at least one orifice controllable to aspirate air through the at least one orifice to grip the sheet;

at least one vacuum sensor that generates signals responsive to magnitude of vacuum at the at least one orifice; and a controller that receives the signals generated by the at least one vacuum sensor and provides a signal indicative of a location of the sheet in the transport system from the signals.

9. A sheet transport system according to claim 8 wherein the vacuum system is controllable to release air to the at least one orifice to release the sheet.

10. A sheet transport system according to claim 8 wherein the controller uses signals from the at least one vacuum sensor to determine if a sheet being transported by a transporter of the at least one transporter is being transported properly.

11. A sheet sport system according to claim 8 wherein an orifice of the at least one orifice is a suction cup.

12. A sheet transport system according to claim 8 wherein the vacuum sensor is a pressure sensor.

13. A sheet tort system according to claim 8 wherein the vacuum sensor is a flow meter.

14. A sheet transport system according to claim 8 wherein the controller determines that a transporter of the at least one transporter is gripping a sheet being transported by the transport system and that the sheet is gripped properly if signals from a vacuum sensor of the at least one vacuum sensor indicate that vacuum sensed by the sensor is greater than a first pre-determined level of vacuum.

15. A sheet transport system according to claim 8 wherein the controller determines that a transporter of the at least one transporter is not gripping a sheet being transported by the transport system if signals from the at least one vacuum sensor indicate that vacuum sensed by the at least one vacuum sensor is less than a second pre-determined level of vacuum.

16. A sheet transport system according to claim 8 wherein the controller determines that a transporter of the at least one transporter is gripping a sheet being transported by the transport system, but that the sheet is gripped improperly, if signals from a vacuum sensor of the at least one vacuum sensor indicate that the vacuum sensed by the sensor is between the first and second vacuum levels.

17. A sheet transport system according to claim 1 wherein the at least one transporter comprises a plurality of sheet transporters.

18. A sheet transport system according to claim 17 wherein sheet transporters of the plurality of sheet transporters seriatim receive and hand off a sheet being transported by the system so as to transport the sheet from the first position to the second position.

19. A sheet transport system according to claim 1 wherein a transporter of the at least one transporter is a rotary transporter, which rotates about an axis to receive and hand off a sheet being transported by the transport system.

20. A sheet transport system according to claim 1 wherein the sheet transport system is a transport system that transports sheets printed in a printing system comprising at least one printing station and wherein the first and second positions are positions of the sheets in the printing system.

21. A sheet transport system according to claim 20 wherein at least one of the first and second positions is a position in a printing station of the at least one printing station.

22. A sheet transport system according to claim 21 wherein the printing station comprises an impression roller.

23. A sheet transport system according to claim 22 wherein the first position in the printing station is a position at which a sheet is removed from the impression roller.

24. A sheet transport system according to claim 22 wherein the second position in the printing station is a position at which a sheet is mounted on the impression roller.

* * * * *